United States Patent [19]

Osborne

[11] 4,344,507

[45] Aug. 17, 1982

[54] SELF-LUBRICATING MACHINING APPARATUS

[75] Inventor: Robert L. Osborne, Mount Clemens, Mich.

[73] Assignee: LaSalle Machine Tool, Inc., Troy, Mich.

[21] Appl. No.: 97,642

[22] Filed: Nov. 27, 1979

[51] Int. Cl.[3] ..... F01M 9/00

[52] U.S. Cl. ..... 184/6.18; 184/6.12; 184/6.14; 74/467; 415/88

[58] Field of Search ..... 184/31, 6.18, 6.12, 184/6.14; 74/467; 415/88

[56] References Cited

U.S. PATENT DOCUMENTS

| | | | |
|---|---|---|---|
| 1,604,078 | 10/1926 | Schneider | 184/6.18 X |
| 2,085,814 | 7/1937 | Matthews et al. | 184/6.12 |
| 2,334,775 | 11/1943 | Karp | 184/6.12 X |
| 2,529,997 | 11/1950 | Browne | 184/6.18 X |
| 2,583,583 | 1/1952 | Mangan | 184/6.18 X |
| 2,719,667 | 10/1955 | Kaczor | 184/6.18 X |
| 2,728,414 | 12/1955 | Drissner | 184/6.14 |
| 2,793,714 | 5/1957 | Luenberger | 184/6.18 |
| 2,810,615 | 10/1957 | Roesch et al. | 184/6.18 X |
| 3,848,702 | 11/1974 | Bergman | 184/6.18 X |
| 4,068,740 | 1/1978 | Quinn et al. | 184/6.12 |

FOREIGN PATENT DOCUMENTS

| | | | |
|---|---|---|---|
| 563611 | 1/1958 | Belgium | 184/6.18 |
| 473189 | 4/1951 | Canada | 184/6.14 |
| 831187 | 2/1952 | Fed. Rep. of Germany | 184/6.18 |
| 338209 | 6/1959 | Switzerland | 184/6.18 |
| 568991 | 4/1945 | United Kingdom | 184/6.18 |

*Primary Examiner*—David H. Brown

*Attorney, Agent, or Firm*—Olsen and Stephenson

[57] ABSTRACT

A lubricating system for machining apparatus having a transmission unit for driving a work-performing tool. The lubricating system includes a housing in which the transmission unit is located and which forms a reservoir for lubricating fluid so that those portions of the transmission unit submerged in the lubricating fluid are continuously lubricated. A passage is formed in the housing and a threaded member is positioned in the passage in close fitting relationship therewith. The passage has an inlet in fluid communication with the reservoir and an outlet in fluid communication with a conduit for conveying lubricating fluid from the passage to selected components of the transmission unit requiring lubrication. The threaded member is rotated by the transmission unit to force lubricating fluid from the reservoir through the passage and the conduit onto those selected components of the transmission unit as it operates.

1 Claim, 3 Drawing Figures

SELF-LUBRICATING MACHINING APPARATUS

BACKGROUND OF THE INVENTION

The present invention relates to a lubricating system used in machining apparatus, in particular, to a lubricating system used in a machining head such as a drill head.

Machining heads commonly have a plurality of work performing tools which are concurrently driven so that a number of machining operations can be performed simultaneously on a workpiece during a single machining cycle. The tools usually are driven through a transmission gear unit by a single input shaft. The transmission unit is housed in a gear box in which lubricating fluid is contained. Portions of the transmission unit are submerged in the lubricating fluid and thus are adequately lubricated. A lube pump is required to pump the lubricating fluid to selected feed points where lubricating fluid can be applied to those components of the transmission unit above the level of the lubricating fluid. These types of lubricating systems are costly and require substantial maintenance.

It is the general object of this invention, therefore, to provide a self-lubricating machining apparatus.

It is another object of this invention to provide a machining head with an integral lubricating system which obviates the need for a conventional lubricating pump.

SUMMARY OF THE INVENTION

The present invention provides an improved lubricating system for machining apparatus. The machining apparatus includes a work performing tool driven by a motor through a transmission unit. The transmission unit is housed in a gear box which also serves as a reservoir for lubricating fluid for lubricating the components of the transmission unit. The transmission unit consists of an input shaft, at least one idler shaft and a spindle shaft to which the work performing tool is secured. The shafts, which are rotatably supported by bearing assemblies, carry gears which are meshed to transmit the rotary motion of the input shaft to the spindle.

The lubricating system of the present invention includes a selected number of integral pump units driven by the transmission unit to lubricate selected components of the transmission unit. Each pump unit consists of a passage formed in the gear box having an inlet in fluid communication with the reservoir to admit lubricating fluid to the passage. A threaded member is rotatably disposed in the passage in close fitting relationship therewith. That is, the outside diameter of the thread member is only slightly less than the inside diameter of the passage. In the illustrated embodiment, the end of one of the shafts is threaded to form the threaded member so that rotation of the shaft rotates the threaded member. A discharge conduit is in fluid communication with the passage and extends above the level of lubricating fluid in the reservoir. Rotation of the input shaft rotates the threaded member to force lubricating fluid through the passage and the discharge conduit to selected locations where the lubricating fluid can be applied to those components of the transmission unit located above the level of lubricating fluid in the reservoir.

In one form of the invention, the discharge conduit comprises an internal bore formed axially through the shaft which rotates the threaded member. The lubricating fluid is forced through the internal bore and is discharged in the vicinity of the bearing supporting the shaft for application thereto.

Further objects, features and advantages of the present invention will become apparent from a consideration of the following description when taken in connection with appended claims and the accompanying drawing in which:

Figure 1:
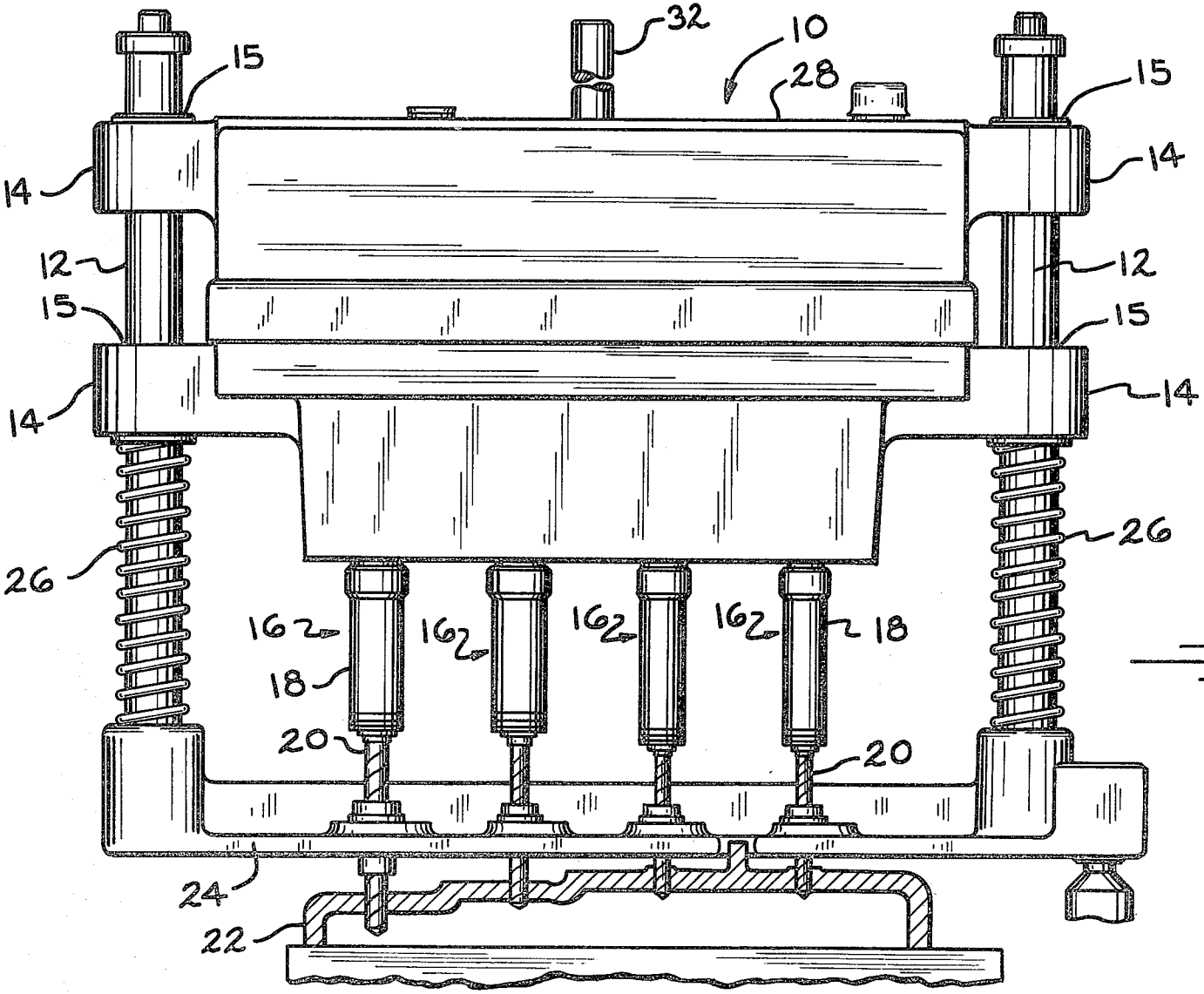
FIG. 1 is a diagrammatic elevational view of a vertical drill head employing the lubricating system of the present invention.

Referring to the drawing, the lubricating system of the present invention is adapted for use in machining apparatus such as a vertically movable drill head, indicated generally at 10 in FIG. 1. The drill head 10 is mounted for vertical guided movement on guide pins 12 by laterally extending arms 14 having coaxial openings 15. The drill head 10, as shown, has four drills 16 each comprising a chuck 18 to which a drill bit 20 is clamped. The drill bits 20 extend through a drill guide 24 and during a downward stroke of the machining head 10 concurrently drill four holes in the workpiece 22. Springs 26 are mounted on the guide pins 12 and resist the downward movement of the drill head 10 as it descends toward the workpiece 22.

Figure 2:
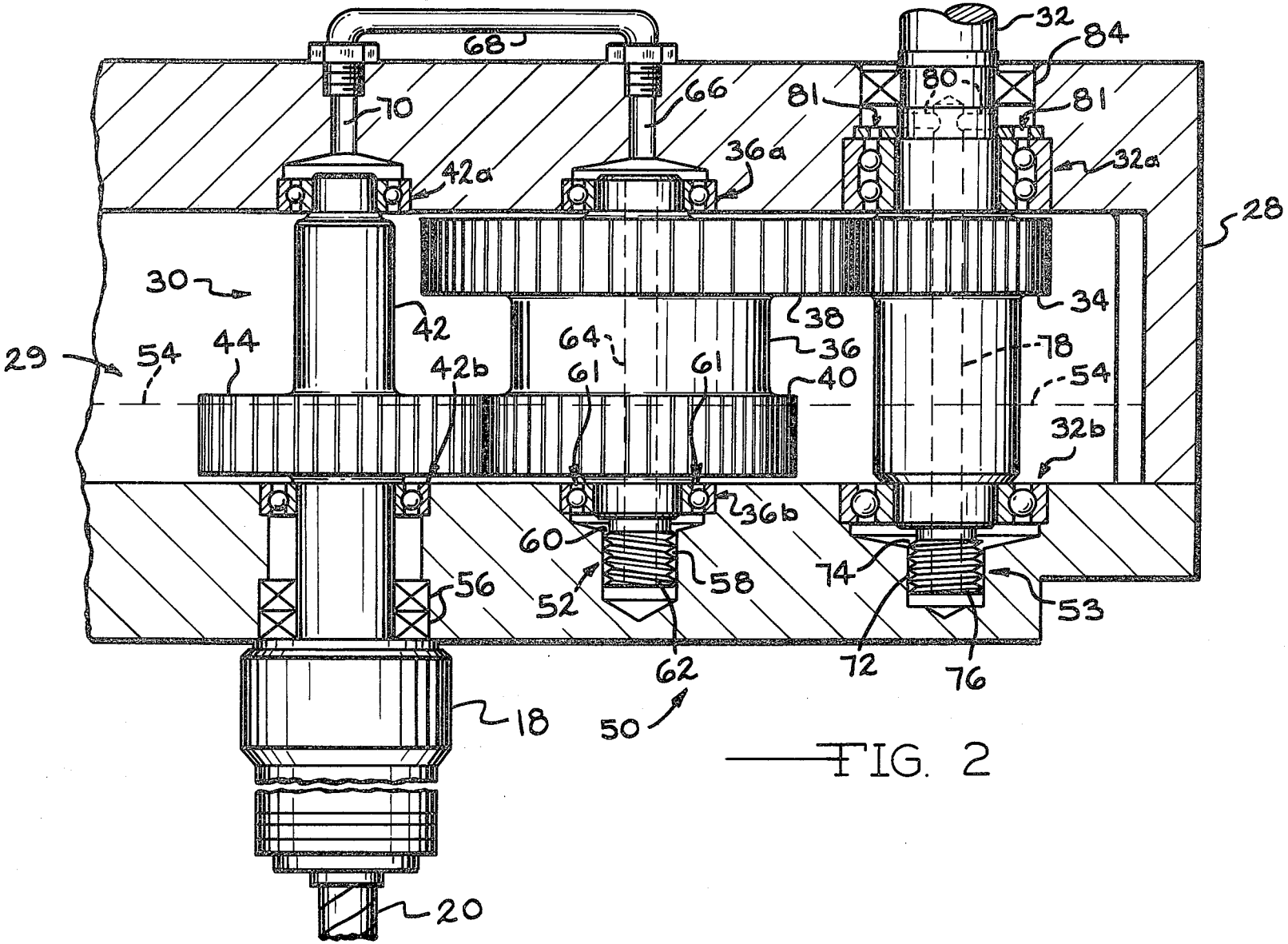
FIG. 2 is a fragmentary elevational view of the drill head illustrated in FIG. 1 with portions broken away to depict the transmission unit and the lubricating system of this invention.

A portion of the drill head 10 is shown in FIG. 2 and it includes a gear box or housing 28 which houses a transmission unit 30 for simultaneously rotating the drills 16. The transmission unit 30 includes an input shaft 32 driven by a motor (not shown) and supported in the gear box 28 by an upper bearing assembly **32*a* and a lower bearing assembly 32*b***.

The transmission unit 30 also includes an idler shaft 36 supported in the gear box 28 by an upper shielded bearing assembly **36*a* and a lower bearing assembly 36*b*. The idler shaft 36 carries an upper gear 38 meshed with a gear 34 on the input shaft 32 and a lower gear 40. A spindle shaft 42 carries a chuck 18 and is rotatably mounted in the gear box 28 by an upper shielded bearing assembly 42*a* and a lower bearing assembly 42*b*. The spindle shaft 42 carries a gear 44 which is meshed with a gear 40 on the idler shaft 36. Rotation of the input shaft 32 causes the idler shaft 36 and the spindle shaft 42 to rotate to drive the drill 16**.

The lubrication system of the present invention, indicated generally at 50 in FIG. 2, comprises integral pump units 52 and 53 for lubricating the transmission unit 30. The gear box 28 serves as a reservoir 29 for lubricating fluid whose level is indicated at 54. The level 54 of the lubricating fluid in the reservoir is established so that it is slightly below the upper faces of the 40 and 44 gears so that when the shafts 32, 36 and 42 are spinning the gears 40 and 44 will splash lubricating fluid within the gear box 28 to disperse further the lubricating fluid onto the transmission unit 30. Seals 56 around the spindle shaft 42 prevent seepage of lubricating fluid from the gear box 28.

The pump unit 52 includes a cylindrical passage 58 formed in the housing 28 in axial alignment with the idler shaft 36. The passage 58 has an inlet 60 in fluid communication with the reservoir 29 of lubricating fluid for admitting lubricating fluid to the passage 58. The lubricating fluid flows through flow paths 61 in the lower bearing 36*b* to enter the inlet 60 of the passage 58. A threaded member 62 having an helical thread is disposed in the passage 58 in close fitting relationship with the cylindrical walls forming the passage 58. The lower end of the idler shaft 36 is threaded to form the threaded member 62 so that rotation of the idler shaft 36 produces a corresponding rotation of the member 62. An internal bore 64 is formed axially through the idler shaft 36 and is in fluid communication with the passage 58 to form a discharge conduit. Rotation of the idler shaft 36 rotates the threaded member 62 in the passage 58 which causes lubricating fluid to be forced from the reservoir through the passage 58 and the internal bore 64 to a level above the level 54 of the lubricating fluid in the housing 28. The internal bore 64 is in fluid communication with the upper bearing assembly 36*a* for supplying lubricating fluid thereto, and is connected to a port 66, a line 68, and a port 70 to be in fluid communication with the upper bearing assembly 42*a* supporting the spindle shaft 42 to lubricate the upper bearing 42*a*. The lubricating fluid flows through the bearing assembly 42*a* and returns to the reservoir for recirculation while a portion of the lubricating fluid flows through the bearing assembly 36*a* back to the reservoir 29.

The pump unit 53 is operatively associated with the input shaft 32 and consists of a passage 72 having an inlet 74 in fluid communication with the reservoir 29. An integral extension of the lower end of the input shaft 32 is threaded to form a threaded member 76 which is rotatably positioned in the cylindrical passage 72 in close fitting relationship therewith. Discharge conduit means in the form of an internal bore 78 is formed axially in the shaft 32 and extends upwardly into communication with discharge ports 80 that extend transversely through the shaft 32 at locations above the upper bearing assembly 32*a*. Rotation of the input shaft 32 forces lubricating fluid from the reservoir 29 through the passage 72 and the bore 78 for discharge from the ports 80. A seal 84 above the discharge port 80 prevents leakage of lubricating fluid from around the shaft 32.

The lubricating fluid discharged from the ports 80 returns to the reservoir 29 through flow paths 81 in the bearing assembly 32*a*. The lubricating fluid flowing through the bearing assembly 32*a* drops against the gear 34 and is further dispersed as the gear 34 revolves. The lubricating system 50 of the present invention employs the rotary shafts of the transmission unit 30 to pump the lubricating fluid throughout the gear box 28 thereby eliminating the need for conventional lube pumps.

Figure 3:
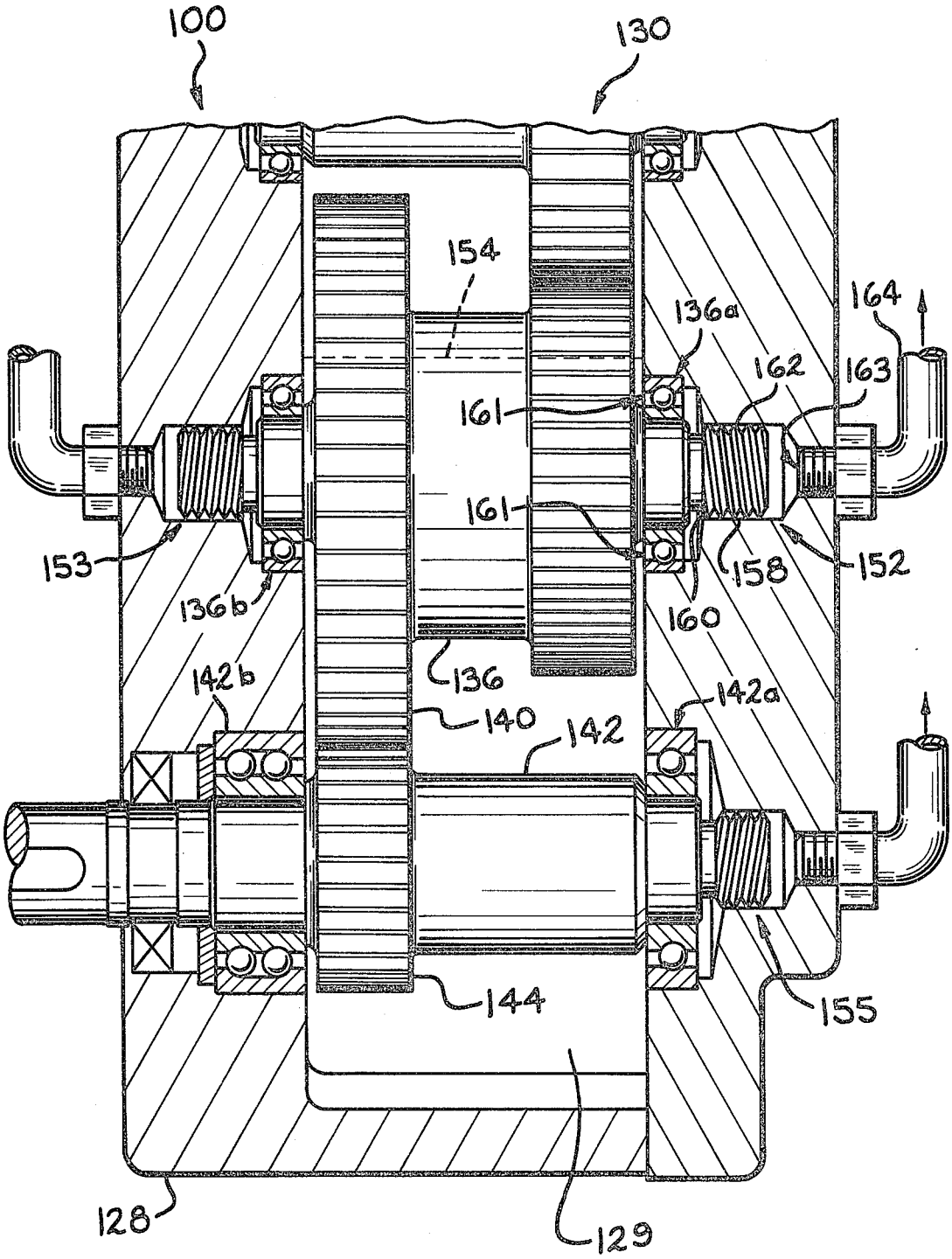
FIG. 3 is a fragmentary elevational view in section of a horizontally movable machining head employing the lubricating system of the present invention.

The lubricating system of the present invention is readily adapted for use in a horizontally movable head 100, as shown in FIG. 3. The machining head 100 has a transmission unit 130 comprising a horizontal idler shaft 136 supported by bearing assemblies 136*a* and 136*b* and a spindle or drive shaft 142 rotatably supported by bearing assemblies 142*a* and 142*b* in a gear box 128. A gear 144 on the shaft 142 meshes with a gear 140 on the idler shaft 136 so that the rotary motion of an input shaft (not shown) is transmitted to the shaft 142. Lubricating fluid is contained in the gear box 128 which forms a reservoir 129 and has a level shown at the broken line 154. The bearing assemblies 136*a*, 136*b*, 142*a* and 142*b* are in fluid communication with the lubricating fluid because they are disposed below the level 154 of the lubricating fluid.

Integral pump units 152, 153 and 155 are provided for pumping lubricating fluid to feed points above the level 154 of the fluid in the reservoir 129. The pump units 152 and 153 are operatively associated with the idler shaft 136 while the pump and unit 155 is operatively associated with the shaft 142. Only the pump unit 152 will be described in detail since the pump units 153 and 155 are essentially identical. The pump unit 152 comprises a threaded member 162 formed by cutting a thread in the end of the idler shaft 136. The threaded member 162 is disposed in a cylindrical passage 158 having an inlet 160 in fluid communication with the lubricating fluid in the reservoir 129 through flow paths 161 in the bearing assembly 136*a*. The passage 158 has a discharge outlet 163 in fluid communication with a line 164. Rotation of the idler shaft 136 causes the threaded member 162 to force lubricating fluid through the passage 158 and the conduit 164 to a feed point for application to selected components of the transmission unit 130. The pump units 152, 153 and 155 cooperate to fully lubricate the transmission unit 130. The pump units 152 and 153 are at each end of the idler shaft 136 while the pump unit 155 is at one end of the drive shaft 142.

The threaded members have either right handed or left handed threads depending upon the rotation of the associated shaft so that the lubricating fluid will be forced through the discharge conduit. Accordingly, the threaded member 72 of the pump unit 53 in the drill head 10 has a right handed thread as the input shaft 32 is rotated in a left handed or counterclockwise direction when viewed from above. Similarly, the threaded member 62 on the idler shaft 36 has a left handed thread as the idler shaft is rotated in a right handed direction or clockwise when viewed from above.

The lubricating system 50 of the present invention for the drill head 10 (FIG. 2) operates as follows. Rotation of the input shaft 32 causes the idler shaft 36 and the spindle shaft 42 to rotate to rotate the drill bit 20. Rotation of the input shaft 32 causes the threaded member 76 to rotate in the passage 72 to force lubricating fluid from the reservoir 29 through the passage 72 and the internal bore 78 for discharge from the ports 80 onto the upper bearing assembly 32*a*. The lubricating fluid flows through the flow paths 81 in the upper bearing assembly 32*a* thereby lubricating it and eventually returning to the reservoir 29 for recirculation. Rotation of the idler shaft 36 rotates the threaded member 62 to force lubricating fluid through the passage 58, the conduit 64, the port 66, the line 68 and the port 70 onto the upper spindle bearing assembly 42*a*. A portion of the lubricating fluid flows through the upper bearing 36*a* of the idler shaft 36 onto the gear 38 and back to the reservoir 29.

The pump units 152, 153 and 155 of the machining head 100, in contrast to the pump units 52 and 53 of the drill head 10 force the lubricating fluid through different discharge paths. Whereas, the shafts 32 and 36 have internal bores in communication with their respective passages, the shafts 136 and 142 of the head 100 are solid and the passages are connected to lines which extend externally of the head 100.

From the above description, it can be seen that an improved lubricating system is provided which eliminates the need for additional lubricating pumps. The integral pump units pump lubricating fluid to selected components of the transmission unit. The lubricating system 50 of this invention is efficient, eliminates conventional pumps and requires a minimal amount of service.

It is claimed:

1. In machining apparatus comprising a work-performing tool and transmission means for actuating said work-performing tool to machine a workpiece, a lubricating system for supplying lubricating fluid to select portions of said transmission means, said lubricating system comprising a housing in which said transmission means is located, said housing forming a reservoir in which lubricating fluid is contained, means forming a passage having an inlet in fluid communication with said reservoir to admit lubricating fluid into said passage, a rotatable threaded member disposed in said passage in close fitting relationship therewith and being operatively associated with said transmission means, and discharge conduit means in fluid communication with said passage and extending above the level of said lubricating fluid in said reservoir to a position where lubricating fluid can be supplied to said selected portions of said transmission means, said threaded member being rotatable in response to operation of said transmission means to force lubricating fluid from the reservoir through said discharge conduit means onto said selected portions of said transmission means, said transmission means including a rotary input shaft, at least one idler shaft and a spindle shaft on which said work-performing tool is mounted, and coacting means on said shafts for transmitting the rotation of said input shaft to said spindle shaft, bearing means including a plurality of bearing assemblies supporting said shafts for rotational movement, at least some of said bearing assemblies being located above the level of lubricating fluid in said reservoir, said passage means and said threaded member being operatively associated with one of said shafts, said conduit means extending from said passage to a selected bearing assembly above said lubricating fluid to supply lubricating fluid thereto, said bearing assemblies including a spindle bearing assembly located above said lubricating fluid and supporting said spindle shaft, an idler bearing assembly supporting said idler shaft, and an input shaft bearing assembly, said conduit means being in fluid communication with said spindle bearing assembly whereby rotation of said input shaft forces lubricating fluid onto said spindle bearing assembly, said passage means and said threaded member being operatively associated with said idler shaft, said threaded member being an integral portion of said idler shaft, a second passage having an inlet in fluid communication with said reservoir and a second threaded member disposed in said passage in close fitting relationship therewith and being an integral portion of said input shaft, and second conduit means in fluid communication with said second passage and said input shaft bearing assembly whereby rotation of said input shaft causes the lubricating fluid to be forced through said conduit means to lubricate said bearing assemblies.

* * * * *